US009051086B2

(12) United States Patent
Lynch et al.

(10) Patent No.: US 9,051,086 B2
(45) Date of Patent: Jun. 9, 2015

(54) ICE TOTE HAVING A HANGING DEVICE

(75) Inventors: Andrew P. Lynch, Burlington, WI (US); Bernie Ziebart, Pewaukee, WI (US)

(73) Assignee: San Jamar, Inc., Elkhorn, WI (US)

( * ) Notice: Subject to any disclaimer, the term of this patent is extended or adjusted under 35 U.S.C. 154(b) by 301 days.

(21) Appl. No.: 12/694,040

(22) Filed: Jan. 26, 2010

(65) Prior Publication Data

US 2010/0187242 A1 Jul. 29, 2010

Related U.S. Application Data

(60) Provisional application No. 61/147,366, filed on Jan. 26, 2009.

(51) Int. Cl.

| | |
|---|---|
| ***B65D 25/28*** | (2006.01) |
| ***B65D 25/22*** | (2006.01) |
| ***B65D 25/32*** | (2006.01) |

(52) U.S. Cl.

CPC ..... *B65D 25/2838* (2013.01); *B65D 25/22* (2013.01); *B65D 25/32* (2013.01)

(58) Field of Classification Search

CPC ..... B65D 25/32; B65D 25/325; B65D 25/22; B65D 25/2844; B65D 25/2852; B65D 25/2864; B65D 25/2879; F25C 5/007; A47G 29/087

USPC ..... 220/476, 480, 482, 757, 760, 773, 751; 248/210

See application file for complete search history.

(56) References Cited

U.S. PATENT DOCUMENTS

| | | | | | |
|---|---|---|---|---|---|
| 584,718 | A | * | 6/1897 | Witcher | 220/762 |
| 815,425 | A | | 3/1906 | Hamilton | |
| 930,824 | A | * | 8/1909 | Wood | 16/445 |
| 1,793,072 | A | | 2/1931 | Fanan | |
| 2,038,826 | A | * | 4/1936 | Carroll | 220/773 |
| 2,156,274 | A | * | 5/1939 | Brown | 217/125 |
| 2,316,103 | A | | 4/1943 | Reed | |
| 2,508,258 | A | * | 5/1950 | Heinrich | 248/210 |
| 2,823,004 | A | | 2/1958 | Melloh | |
| 2,908,468 | A | * | 10/1959 | Thomas | 248/210 |
| 2,968,462 | A | | 1/1961 | Jones | |
| 3,111,153 | A | * | 11/1963 | Sonka et al. | 206/428 |
| 3,578,205 | A | | 5/1971 | Ballester | |
| 4,013,187 | A | | 3/1977 | Betka | |
| 4,149,663 | A | * | 4/1979 | Agar | 220/491 |
| D252,439 | S | | 7/1979 | Smith | |
| 4,177,896 | A | | 12/1979 | Weavers et al. | |
| 4,183,444 | A | | 1/1980 | English et al. | |
| 4,337,565 | A | | 7/1982 | Diana | |
| 4,351,445 | A | | 9/1982 | Giggard et al. | |
| 4,355,597 | A | * | 10/1982 | Blasbalg | 119/57.8 |
| 4,418,883 | A | | 12/1983 | Cohen | |
| 4,519,520 | A | | 5/1985 | Hill | |
| 4,593,833 | A | | 6/1986 | Hill | |

(Continued)

*Primary Examiner* — Stephen Castellano

(74) *Attorney, Agent, or Firm* — Boyle Fredrickson, S.C.

(57) ABSTRACT

A container includes a vessel defining an internal volume adapted to be loaded with a removable material, a handle connected to the vessel, and a hanging device associated with the handle for hanging the vessel onto an upright structure, such as the front wall of an ice machine when the container is being used as an ice tote. The handle is rotatable between a raised position and a lowered position, and the hanging device is connected to the handle so as to rotate with it. This construction allows a user to dismount the container from the upright member with rotation of the handle from the lowered position to the raised position.

18 Claims, 14 Drawing Sheets

(56) References Cited

U.S. PATENT DOCUMENTS

| | | | | |
|---|---|---|---|---|
| 5,085,391 | A | 2/1992 | Berger et al. | |
| 5,276,943 | A * | 1/1994 | Ludy | 16/445 |
| 5,390,443 | A | 2/1995 | Emalfarb et al. | |
| 5,402,910 | A * | 4/1995 | Pilney | 220/751 |
| 5,636,886 | A | 6/1997 | Jensen | |
| 6,027,152 | A | 2/2000 | Sawdey | |
| 6,076,700 | A | 6/2000 | Manges | |
| 6,299,116 | B1 | 10/2001 | Levesque | |
| 6,352,169 | B2 | 3/2002 | Foster | |
| 7,024,816 | B1 | 4/2006 | Marks et al. | |
| 2008/0099649 | A1 | 5/2008 | Cavasos | |
| 2010/0187242 | A1 * | 7/2010 | Lynch et al. | 220/662 |

* cited by examiner

ICE TOTE HAVING A HANGING DEVICE

CROSS-REFERENCE TO RELATED APPLICATION

This application claims the benefit of U.S. Ser. No. 61/147,366, filed Jan. 26, 2009.

BACKGROUND AND SUMMARY OF THE INVENTION

The present invention relates generally to transportable containers and, more particularly, to a tote having a hanger for hanging the tote on an upright member.

Ice totes and similar containers are commonly used in the food handling industry. More particularly, it is common for an ice tote to be used to haul ice from the bin of a bulk ice making machine to a drink station at which ice is removed from the ice tote and ultimately loaded into cups. In a similar manner, ice totes are used to haul ice to a chilling station, such as at a grocery store or fishmonger where fish and seafood are kept under ice.

Conventional hand-transportable ice totes are defined by a base supporting an annular wall that extends upward from the base to form an open top. A bail is connected at opposite external sides of the annular wall to facilitate hand carrying of the tote. The base typically has a flat exterior surface that allows the tote to sit sturdily on a planar surface, e.g., floor, table, or shelf, when being loaded or stored. This placement of the ice tote can result in several feet in distance between the point at which ice is collected from the ice making machine and the ice tote itself.

In a typical loading operation, an ice scoop will be plunged into the bin of the ice making machine such that ice is loaded thereon. For many ice scoop designs, the amount of ice initially loaded onto the scoop cannot be maintained during the movements the scoop experiences as it is lifted and pulled from the bin and then brought adjacent to the floor supported ice tote and then tipped to drop the ice into the ice tote. The greater distance between the ice tote and the ice making machine bin, the greater likelihood that ice will fall off the scoop. Moreover, given that so much of the distance between the ice tote and the ice bin is external to the ice making machine, any ice that prematurely falls off the ice scoop is likely to fall onto the floor around the ice making machine. This loss of ice can lead to several undesirable conditions. First, the time to fill the ice tote is increased. Second, the ice in the ice making machine bin is exposed to the warmer, ambient air for a greater time period resulting in a thermal loss. Third, ice that falls to the floor is wasted. All of which negatively impacts the efficiency of the ice making machine. In addition, ice, as well as any unrecovered thawed ice on the floor presents a slippery and potentially unsafe working condition.

If an ice tote is not hung by its bail on a wall or the like it will usually rest on the floor. This creates two additional problems. First, the bottom of the tote will be contaminated and a user's hands can then become contaminated when the tote is handled or hoisted from the bottom. Second, if the tote is filled while sitting on the floor, lifting a full ice tote off the floor can cause unnecessary back strain.

The present invention provides an ice tote with a bail and a hanging device connected to the bail to enable the ice tote to be hung off an upright wall of the bin of an ice making machine when the ice tote is being loaded with ice. In one embodiment, the hanging device is connected to the bail such that rotation of the bail causes rotation of the hanging device.

Thus, when the ice tote is being hung on the ice bin, the bail is automatically rotated downward away from the open top of the ice tote. With this construction, it is not necessary for a user to manually move the bail from interfering with loading ice into the ice tote. Further, when the bail is rotated upward, the hanging device is automatically rotated away from the upright wall of the ice bin to disengage the upright wall. A user therefore is not required to lift the loaded ice tote upward away from the ice bin to dislodge the hanging device from the ice bin.

In a further embodiment, the hanging device is constructed such that when the hanging device is in a fully engaged position, the bail is clear of the opening to the ice tote, but is also spaced from the exterior surface of the ice tote. Maintaining this spacing between the bail and the side of the ice tote makes grabbing of the handle easier and quicker, especially, if the user is wearing gloves.

In yet a further embodiment, the hanging device and the bail are made of separate wires that are welded or otherwise fastened together. In another embodiment, the hanging device and the bail are formed of a single piece of wire. In either embodiment, it is contemplated that a conventionally outfitted ice tote may be retrofitted to have a hanging device in accordance with the present invention.

Therefore, in accordance with one aspect of the present invention, a storage container is provided that seeks to overcome many of the drawbacks associated with ice totes and other containers of the prior art. The storage container is an open-topped vessel into which ice or other material may be loaded. A bail is mounted to opposite sides of the vessel. A hanging device is connected to the bail, and allows the storage container to be hung on an upright member for loading of material therein or for storage.

In accordance with a further aspect, the hanging device pivots with pivoting of the bail, and vice-versa. Thus, when the container is hung on an upright member, the bail is automatically moved to one side of the container. Similarly, when the bail is rotated upward to a position above the container, the hanging device is automatically rotated from a downward facing position to a sideways facing position. In this regard, when the container is hanging on an upright member by virtue of the hanging device being in a downward facing position, rotation of the bail will cause the hanging device to rotate in a manner that releases its retention on the upright member, and disengaging the container from the upright member.

According to another aspect of the invention, a bail with an integral hanging device is provided.

According to yet another aspect, the invention may be used to retrofit a conventional container to have a bail with an integral hanging device.

The present invention will be described with respect to an ice tote, but as will be made apparent from the following description, the invention is also applicable to other hand-transportable containers adapted to carry or store other types of material. In this regard, the use of the term "tote" shall include but not be limited to containers, vessels, receptacles, reservoirs, buckets, kettles, pails, cans, pots, canisters, and the like.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

DETAILED DESCRIPTION

Figure 1:
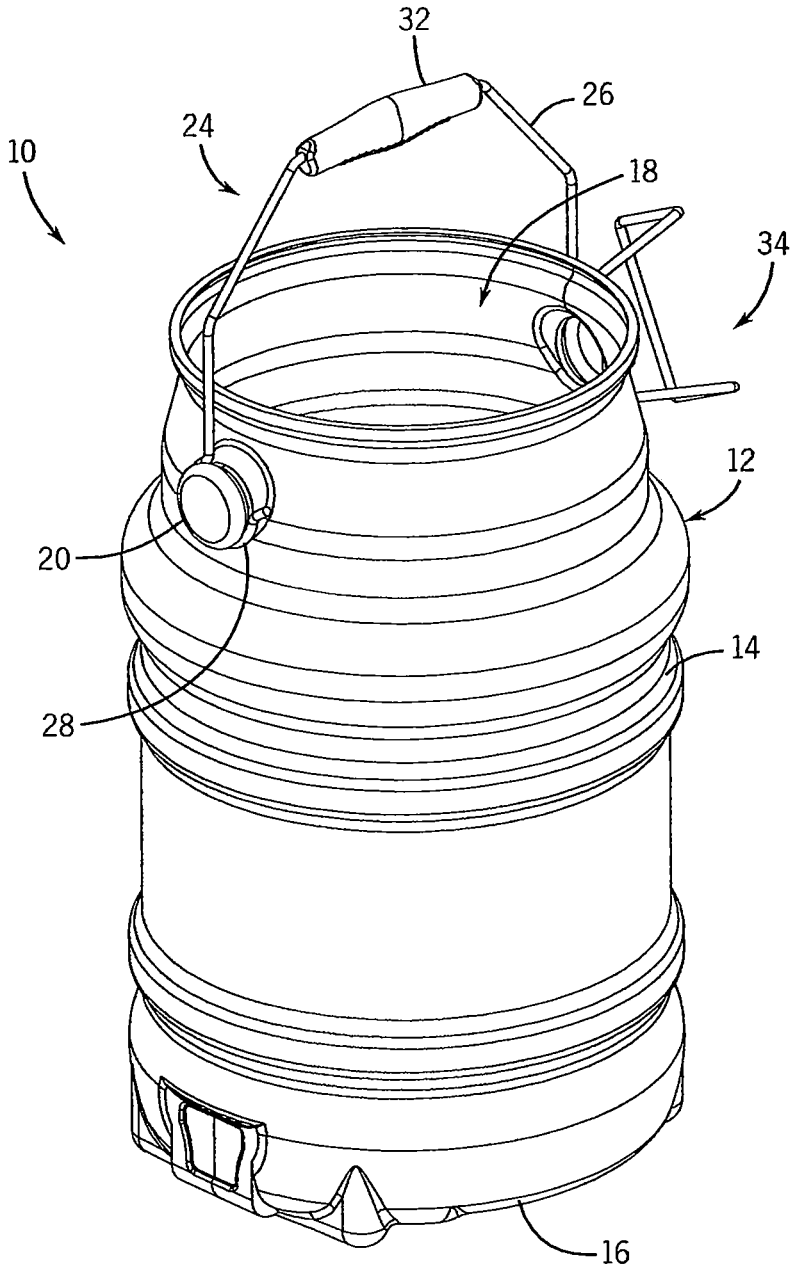
FIG. 1 is an isometric view of a tote according to one embodiment of the present invention, and with a bail of the tote in a raised position and a hanging device connected to the bail in a disengagement position.
Figure 2:
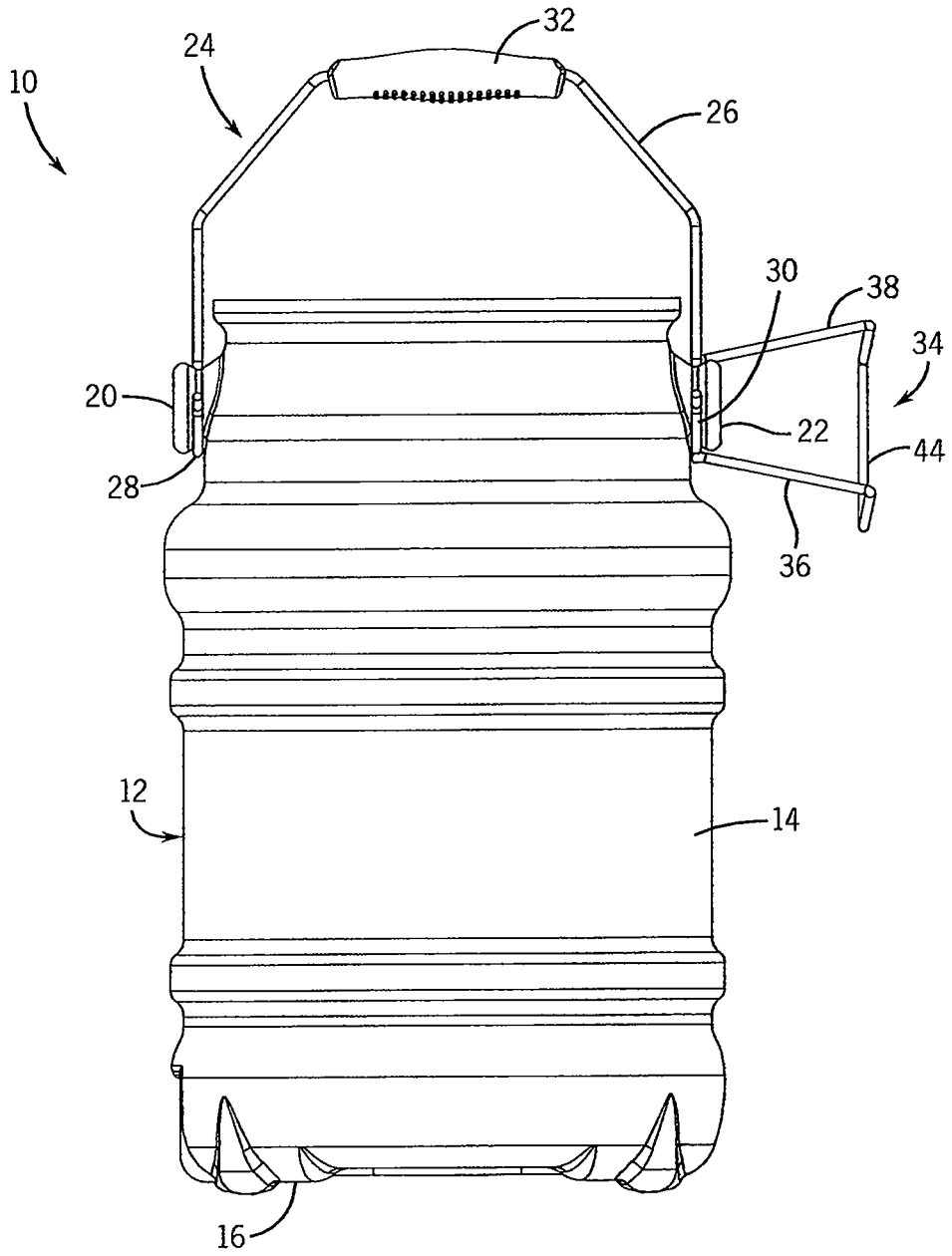
FIG. 2 is a front elevation view of the tote shown in FIG. 1.
Figure 3:
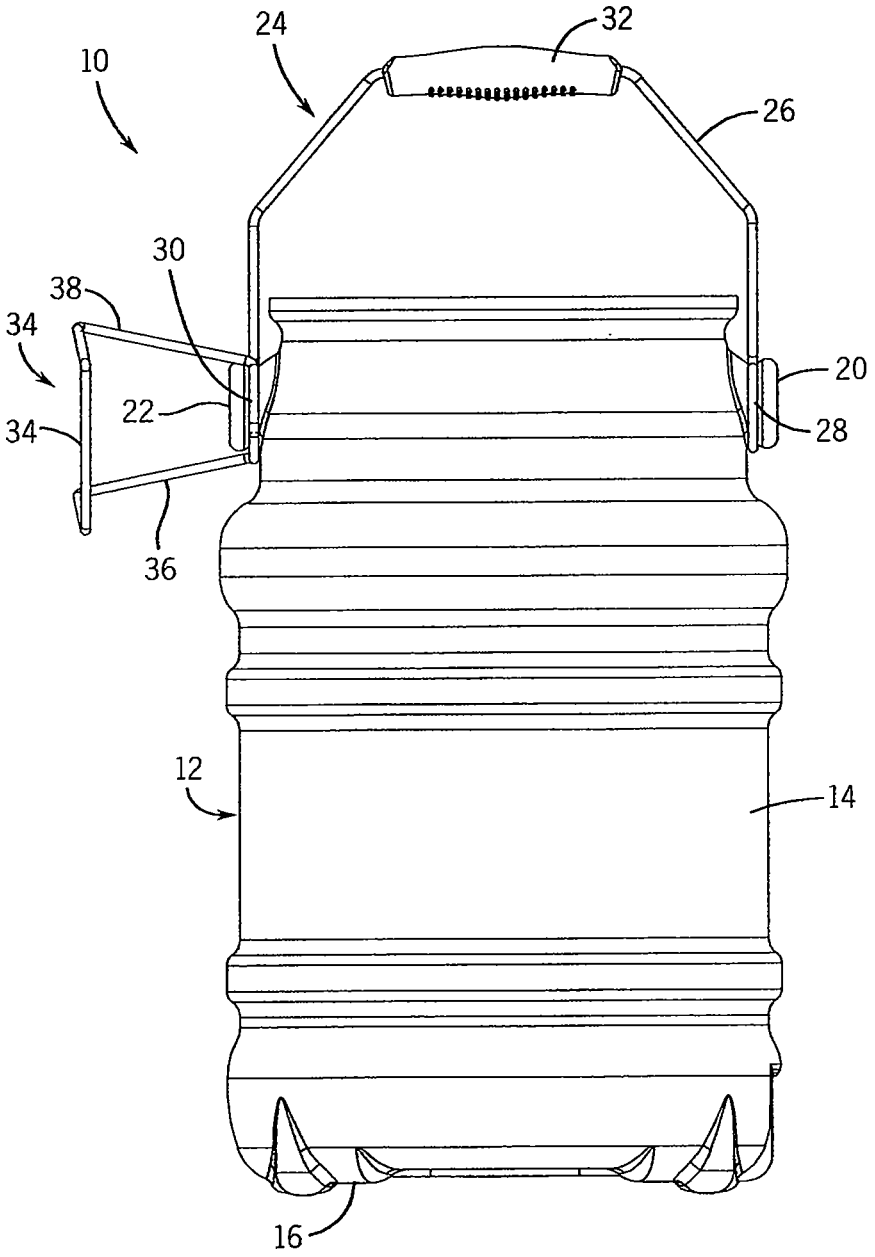
FIG. 3 is a rear elevation view of the tote shown in FIG.
Figure 4:
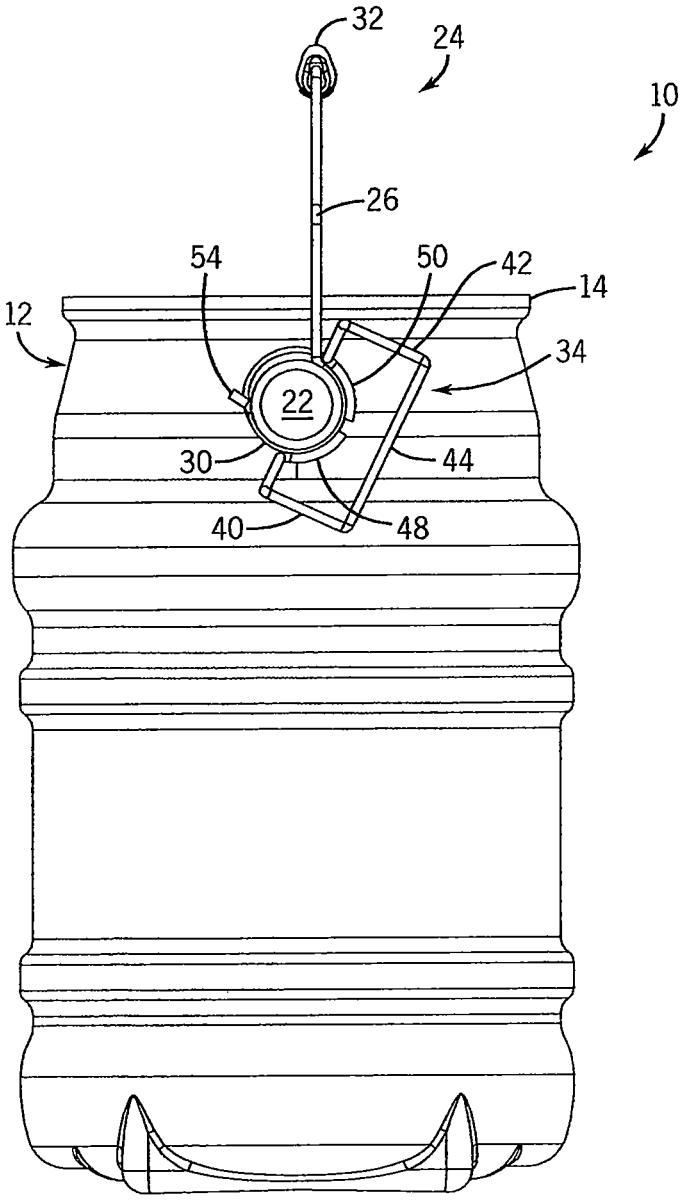
FIG. 4 is an enlarged right side elevation view of the tote shown in FIG. 1.
Figure 5:
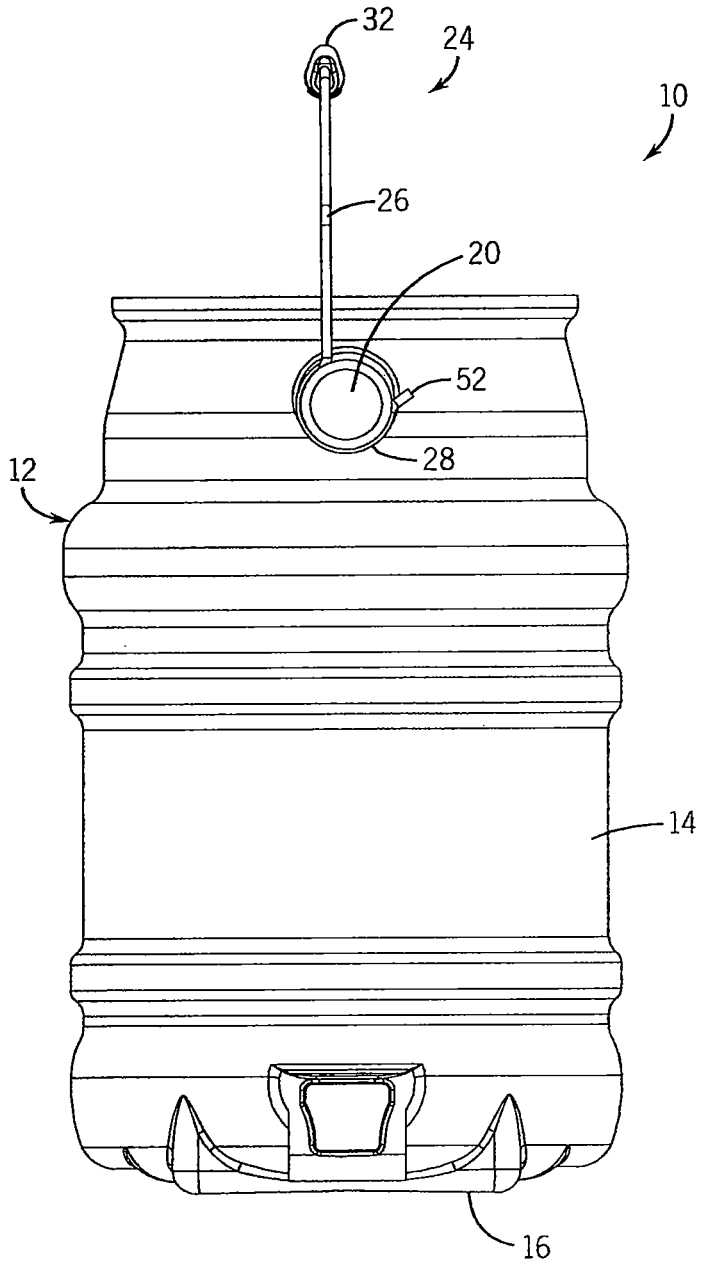
FIG. 5 is a left side elevation view of the tote shown in FIG. 1.

A tote 10 according to one embodiment of the invention includes a vessel 12 defined by an annular wall 14 extending upwardly from and supported by a generally planar base 16. It is understood that that the annular wall and the base 16 may be formed as a single unitary body using any of a number of known or to be developed fabrication processes. In addition, the base 16 may include skid-resistant feet and/or handles as known in the art. The annular wall 14 and the base 16 define an interior volume 18 into which material, such as ice cubes, may be loaded for transport or temporary storage. In one preferred embodiment, the vessel 12 is formed of a generally transparent plastic material adapted for the rigors of the food service industry. While a generally cylindrical vessel 12 is shown, it is understood that a vessel having other shapes is considered within the scope of the invention. Anchor points 20, 22 are formed on opposite external sides of the annular wall 14. The anchor points 20, 22 are aligned with one another and are at substantially the same height along the annular wall 14.

A bail 24, generally defined by a single piece of rust-resistant, reslient wire 26, has a first and second curved end 28, 30 that fit over respective anchor points 20, 22. The wire 26 has a rigidity sufficient to suspend handle 32 above the vessel 12 when the wire 26 is rotated to a position above the vessel 12. The shape of the wire 26 shown in the drawings illustrates but one example as it is understood that the wire may have a shape different from that explicitly shown. The handle 32 preferably has an ergonomic design and is made of plastic suitable for use in the food handling industry.

A hanging device 34 is connected to, or otherwise integrally formed with one of the curved ends 28, 30 of the bail 24. For purposes of illustration, the hanging device 34 is shown connected to curved end 30 of the bail 24. In one embodiment, the hanging device 34 is welded to the curved end 30 but it is understood that other types of structures may be used to interconnect the curved end 30 of the bail 24 and the hanging device 34. Moreover, it is understood that the bail 24 and the hanging device 34 could be formed from a single, continuous length of wire. It is preferred that the bail 24, and thus the hanging device 34, are mounted adjacent the top of the vessel. In another preferred embodiment, the bail 24 is within approximately two inches of the top of the vessel. Preferably the bail 24 and hanging device are mounted between 0 and 2 inches of the top of the vessel 12.

In one embodiment, the hanging device 34 consists of a pair of laterally extending and aligned members 36, 38, a pair of legs 40, 42 extending orthogonally from members 36, 38, and a single connecting member 44 connecting the legs 40, 42. The laterally extending members 36, 38 have a length sufficient to traverse the thickness of an upright member 46, e.g., side wall of an ice bin, onto which the tote 10 is to be hung. The legs 40, 42 have a length sufficient to support tote 10 without the hanging device 34 slipping off the upright member 46.

In another embodiment, the laterally extending members 36 and 38 of the hanging device 34 extend outwardly slightly away from each other such that horizontal distance between members 36 and 38 increases as the distance from the side of the annular wall 14 of the vessel 12 increases. This provides a more stable hanging interface between the hanger and the upright member 46.

In yet another embodiment, the laterally extending members 36 and 38 of the hanging device 34 are angled slightly upwardly, preferably at approximately 5 degrees relative to the horizontal plane of a flat surface on which the vessel 12 is placed. This construction tends to keep the vessel 12 in contact with or closer proximity to the upright member 46 on which it is hung for greater stability.

As noted above, in one embodiment, the hanging device 34 is welded to the bail 24. To provide sufficient surface area for a weldment, the hanging device 34 has a pair of curved arms 48, 50 that extend from members 36, 38, respectively. The curved arms 48, 50 have a curvature generally matched to the curvature of the curved end 30 of the bail 24.

Figure 10:
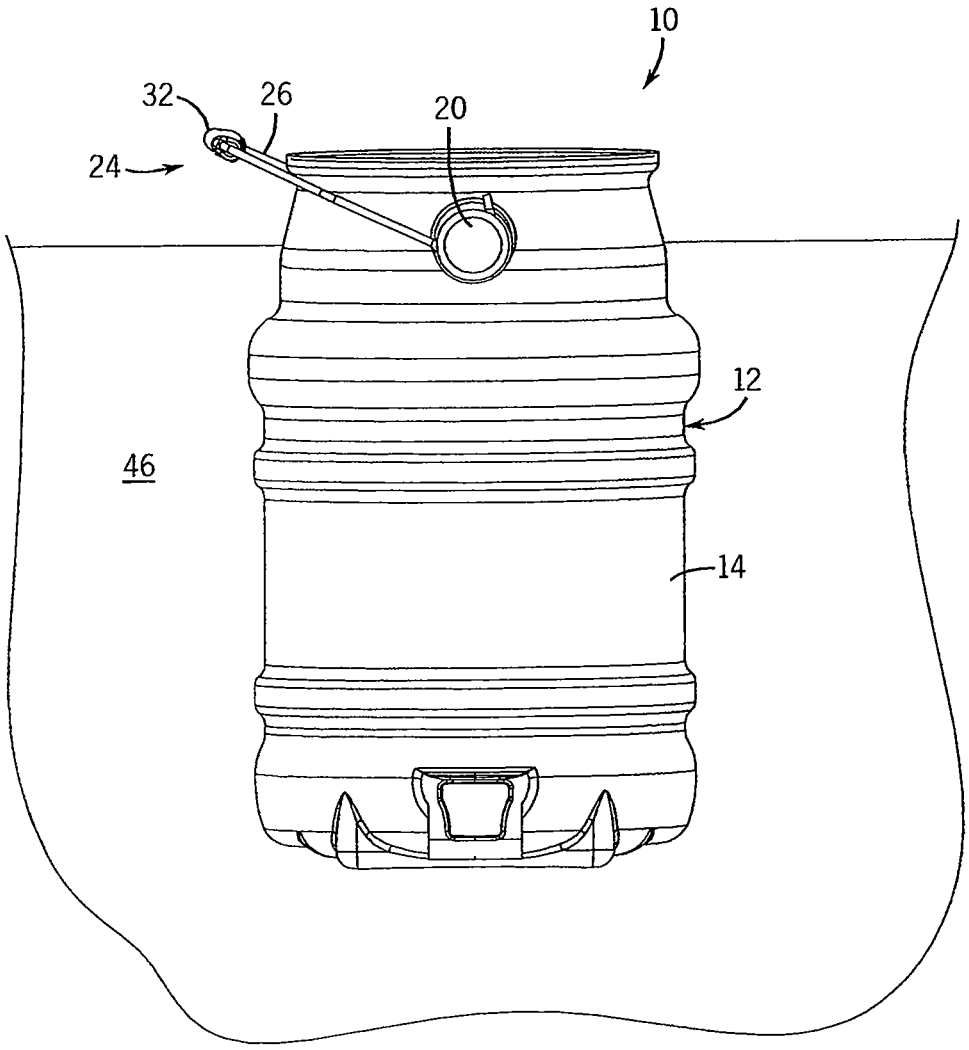
FIG. 10 is a left side elevation view of the tote shown in FIG. 7.

The interconnection of the hanging device 34 and the bail 24 allows the hanging device 34 to rotate with rotation of the bail 24 and, conversely, causes the bail 24 to rotate with rotation of the hanging device 34. Thus, when the tote 10 is to be loaded or stored by hanging the tote 10 on an upright member 46, the tote 10 is lifted by a user holding handle 32 and with the bail 24 generally above the tote 10. In this position, as shown in FIGS. 1-6, the hanging device 34 is rotated such that legs 40, 42 are pointing sideways rather than downward. In this position, the tote 34 cannot be securely hung on the upright member 46. However, as the tote 10 is lowered by a user so that the hanging device 34 contacts the top surface of the upright member 46 and, more particularly, as the member 36 contacts the top surface of the upright member 46, the hanging device 34 will rotate in a direction counter to the rotation of the bail 24 thereby causing the bail 24 to reverse course and follow the rotation of the hanging device 34. The hanging device 34 will rotate until both members 36, 38 rest atop the top surface of the upright member 46. In this position, the tote 10 is suspended from the upright member 46 by the hanging device 34. Because of the interconnection of the bail 24 and the hanging device 34, when the hanging device 34 is in the engaged position, such as illustrated in FIGS. 7-11, the bail 24 is automatically rotated to a side of the vessel 12. However, the rotation is limited by the hanging device 34 so that handle 32 is spaced from the side of the vessel 12 as shown in FIG. 10. This spacing of the handle 32 from the vessel 12 makes it easier for the user to grasp the handle 32.

Figure 6:
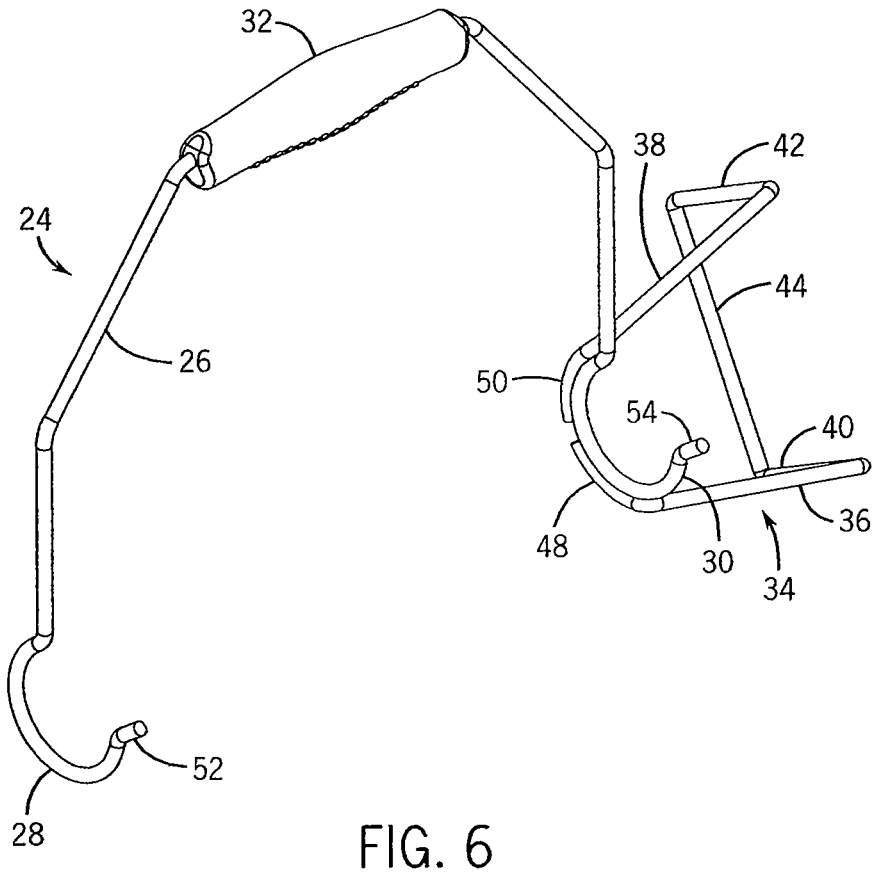
FIG. 6 is an isometric view of the bail and hanging device of the tote shown in FIG. 1.
Figure 7:
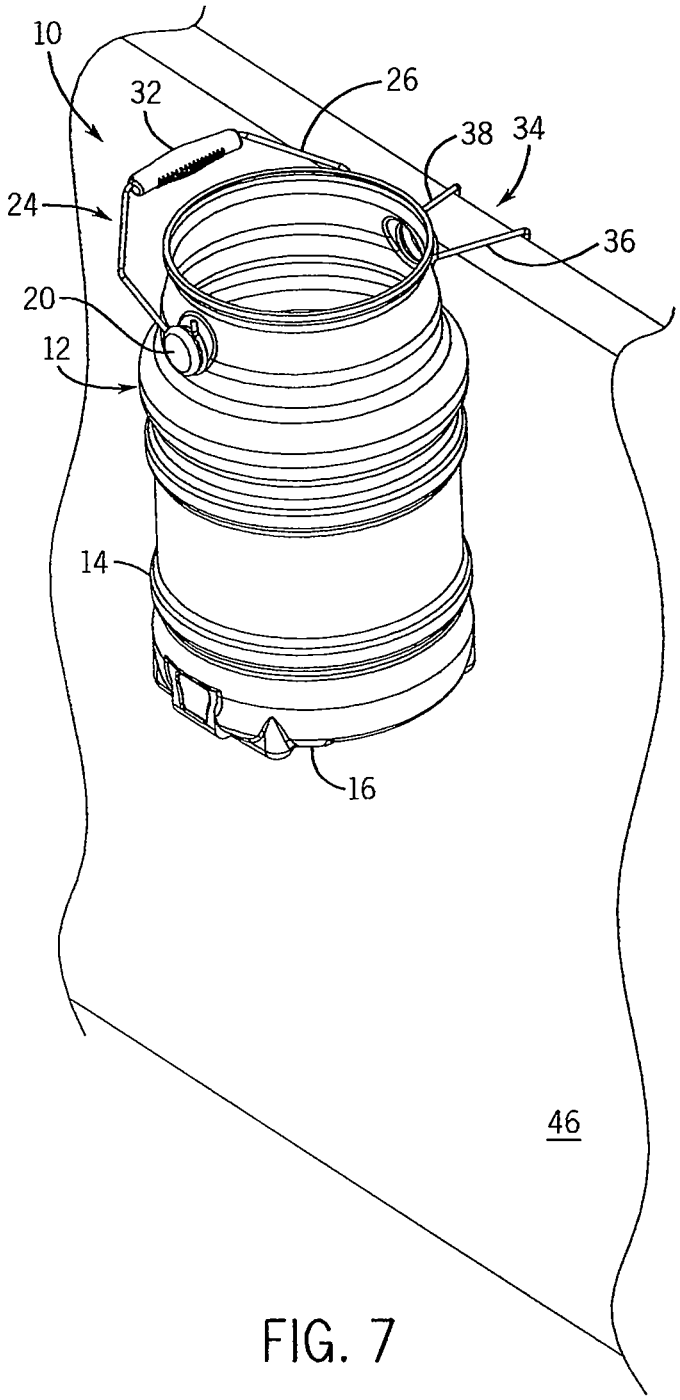
FIG. 7 is a front isometric view of the tote of FIG. 1 hanging on an upright member.
Figure 8:
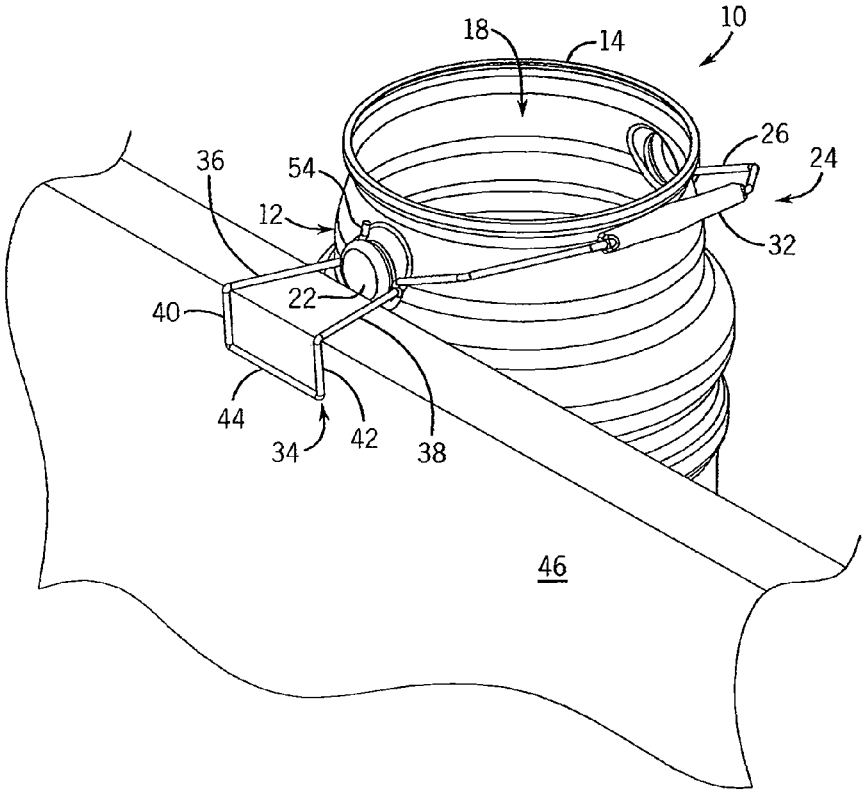
FIG. 8 is a rear isometric view of the tote shown in FIG. 7.
Figure 9:
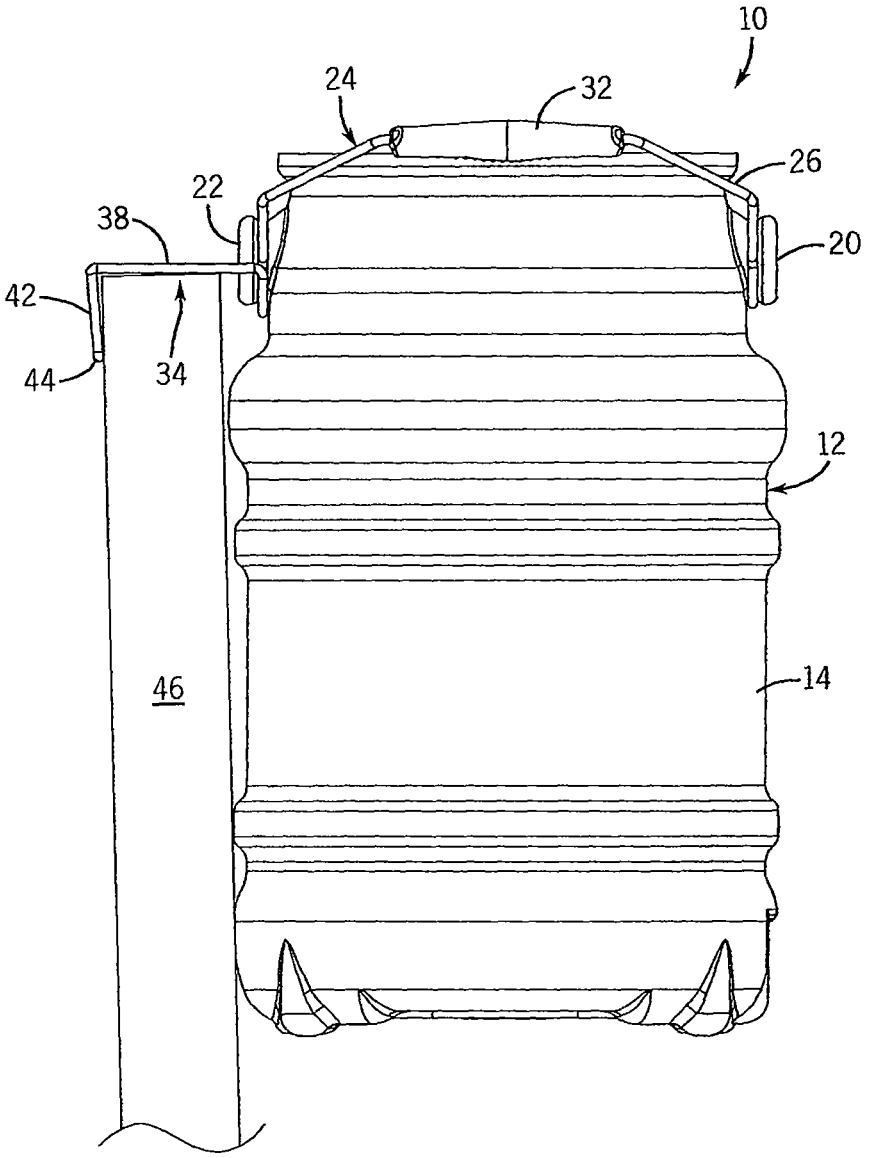
FIG. 9 is a rear elevation view of the tote shown in FIG. 7.
Figure 11:
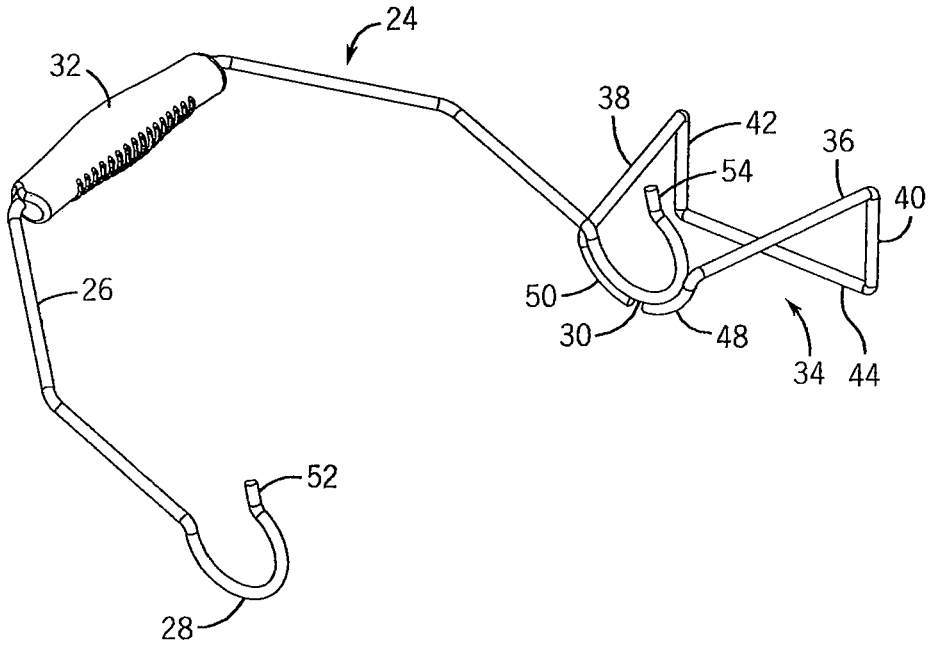
FIG. 11 is an isometric view of the bail and hanging device of the tote in the orientation shown in FIG. 7.

When the bail 24 is rotated from the side position, shown in FIG. 10 for example, to the centered position shown in FIG. 1 for example, the hanging device 34 also rotates in the same direction. That is, if the bail 24 is rotated in a clockwise direction from the position in FIG. 7 to the position in FIG. 1, the hanging device 34 will also rotate in a clockwise direction which results in the legs 40, 42 rotating from a downward oriented position as illustrated in FIG. 11 to a sideways oriented position as illustrated in FIG. 6. This movement effectively disengages the hanging device 34 from the upright member 46 and releases the tote 10 thereby allowing a user to transport the tote 10 as desired without having to formally "unhook" the tote 10 from the upright member 46. It will thus be appreciated that only minimal lifting of the vessel 12 is necessary to release the tote 10 from engagement with the upright member 46. Thus, the hanging device 34 allows the tote to be mounted to an ice bin, loaded, and then removed in a straightforward manner.

Figure 12:
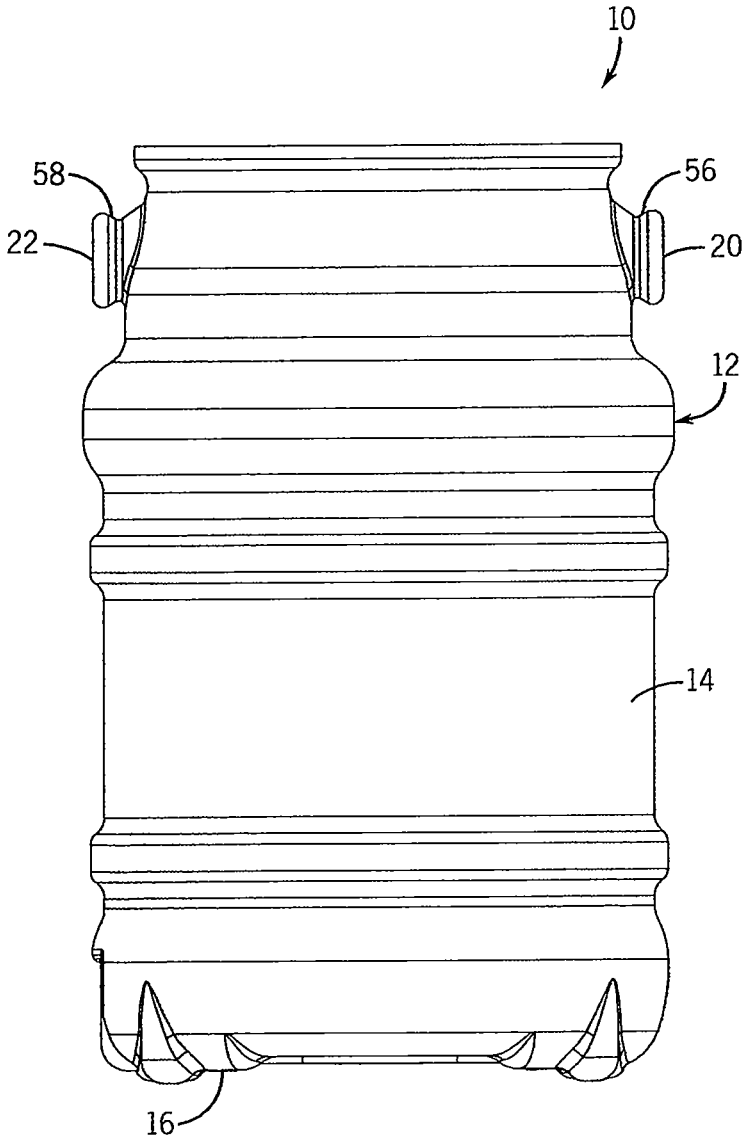
FIG. 12 is a side elevation view of the tote with the bail removed.

In one preferred embodiment, the bail 24 and thus the hanging device 34 are removable from the vessel 12. Such removal is desired for cleaning purposes. In addition, this removability allows a tote having a conventional bail to be retrofitted to have a bail with an integrated hanging device. It is recognized that a number of constructions may be used to provide removability of the bail 24. In one exemplary embodiment, the ends 28, 30 of the bail 24 have a tab feature 52, 54, respectively, that may be pulled by a user to effectively expand the curved ends 28, 30 to fit over the anchor points 20, 22. Thus, the ends 28, 30 of the bail 24 together with their respective tab features 52, 54 form snap rings that may be momentarily expanded to fit over the ends that define annular grooves 56, 58 formed in the anchor points 20, 22, as shown in FIG. 12. When the tab features 52, 54 are released, the default curvature of the curved ends 28, 30 is reclaimed and the ends 28, 20 are secured about the anchor points 20, 22. It is preferred that the default curvature allows the ends to rotate within the annular groves 56, 58 to permit rotation of the bail 24 and hanging device 34 as described above.

It will be appreciated that the position of the hanging device 34 on the bail 24 advantageously clears the hanging device from hitting the legs of the user or other structures as the tote 10 is being carried. It is customary for a loaded tote to be carried with the bail 24 aligned in the direction the user travels. Thus, the present invention provides for the hanging device 34 to either lead the tote 10 or trail the tote 10 as the tote 10 is being carried.

As described herein, in a preferred embodiment, the hanging device 34 is connected to, or integrally formed with the bail 24, so as to rotate with rotation of the bail 24. It is understood however that the invention may also include a hanging device 34 separate from the bail and thus not rotatable therewith or, more appropriately, independently rotatable therefrom.

Figure 13:
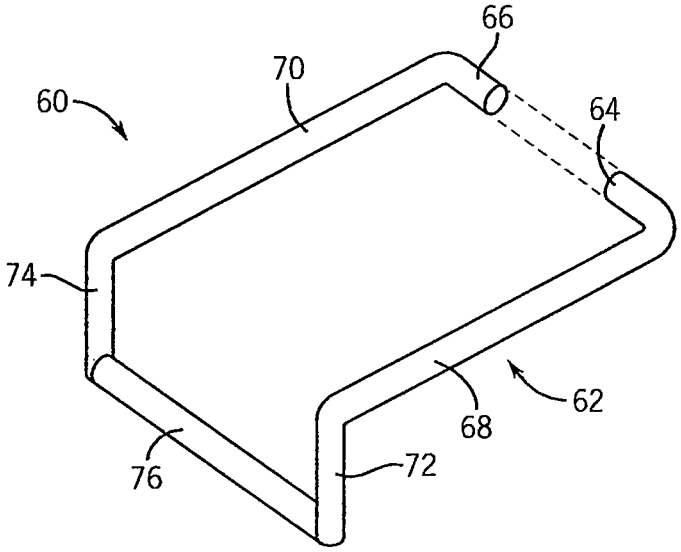
FIG. 13 is an isometric view of a hanging device according to another embodiment of the invention.

FIG. 13 shows a hanging device 60 according to an alternate embodiment of the invention. Hanging device 60 preferably includes a single piece of wire 62 bent to having oppositely facing ears 64, 66, laterally extending arms 68, 70 extending from ears 64, 66, respectively, downwardly extending legs 72, 74 that extend from arms 68, 70, respectively, and a transversely oriented connector 76. The ears 64, 66 are designed to be rotatably received in openings formed in a vessel, e.g., vessel 12. In one embodiment, holes are formed in protrusions 20, 22 for receiving the ears 64, 66. In another embodiment, holes are formed in the annular sidewall of the vessel. In yet another embodiment, the holes are formed in a single protrusion or similar structure formed on one side of the vessel for mounting the hanging device 60 to just one side of the vessel. Preferably, the interconnection of the arms with the legs forms a living hinge that allows limited flexing of the arms relative to the legs. This allows the ears to be removed from engagement with the vessel when desired.

Figure 14:
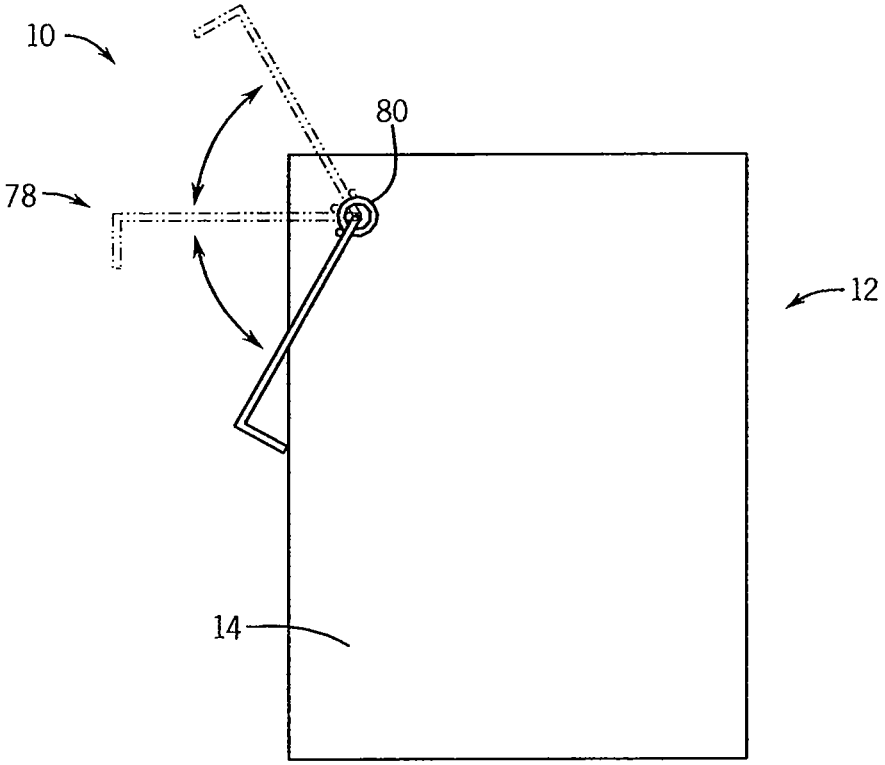
FIG. 14 is a schematic representation of a hanging device and vessel according to another embodiment of the invention.

In yet another embodiment, which is schematically shown in FIG. 14, it is contemplated that the hanging device 78 could be pivoted up or down about a pivot axis 80 formed at the connection of the hanging device 78 with the vessel 12. In this embodiment, the hanging device 78 is disconnected from the bail for the vessel and is thus independently movable. Preferably, a spring or other biasing device biases the hanging device in either a raised position or a lowered position. The hanging device 78 is preferably biased in a lowered position so that by default the hanging device 78 is out of the way. Thus, when the vessel is to be mounted to an ice bin or other support structure, the end of the hanging device 78 is brought into engagement with the ice bin and the vessel is lowered, counter-reacting the bias and facilitating mounting of the vessel on the ice bin. Thus, further to this embodiment, retainers (not shown) are formed with the vessel 12 to lockingly engage the hanging device 78 to hold it in an upright position against its bias.

Figure 15:
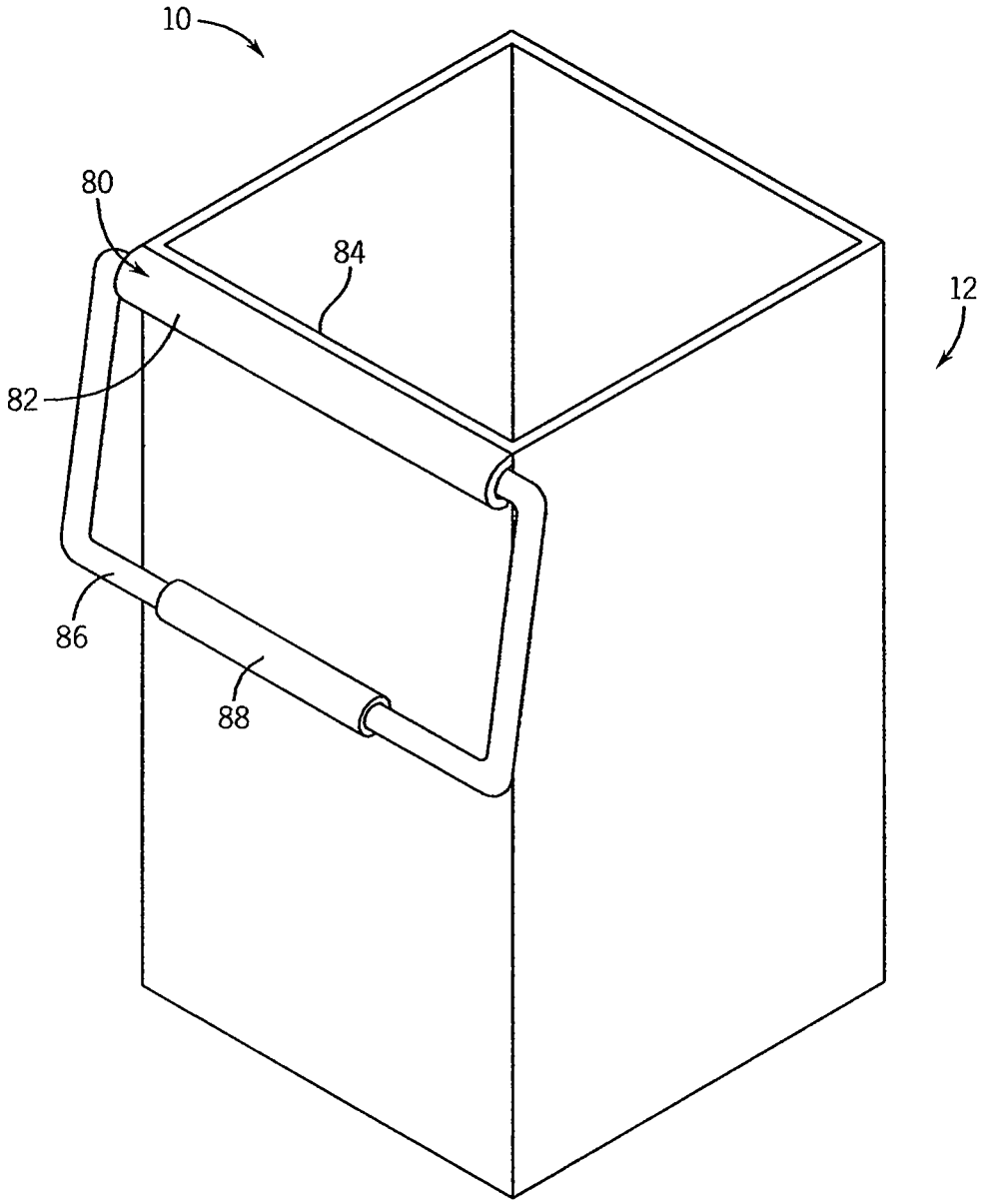
FIG. 15 is an isometric view of a vessel having a hanging device according to a further embodiment of the invention.

FIG. 15 illustrates a hanging device 80 according to another embodiment of the invention. In this embodiment, vessel 12 is shown as having a generally cubic shape, but it is understood that hanging device 80 could be used with cylindrically shaped vessels, such those shown in the other figures. The hanging device 80 includes a downturned lip 82 that is formed with, or coupled to, a top edge 84 of the vessel 12. In this regard, the hanging device 80 extends outwardly from a pourable mouth of the vessel 12. In this embodiment, the hanging device 80 is a stationary member. Preferably, a bail 86 having a handle 88 is connected to the vessel 12 for transporting the vessel 12. In one embodiment, the bail 86 is mounted to the vessel 12 generally adjacently beneath the lip 82 but it is understood that other mounting positions are possible.

It will be appreciated that the shape of the hanging devices described herein are merely exemplary and that other shapes or configurations are possible. It should also be noted the size of the hanging device should be such that the vessel can be mounted to wide support structures, e.g., front wall of an ice bin. In yet a further embodiment, the hanging device is extendable to allow greater reach for the hanging device.

Many changes and modifications could be made to the invention without departing from the spirit thereof. The scope of these changes will become apparent from the appended claims.

The invention claimed is:

1. A container comprising:

a vessel defining an internal volume adapted to be loaded with a removable material;

a handle connected to the vessel, the handle rotatable about an axis of rotation between a raised position associated with vertical suspension of the vessel and a lowered position; and a hanging device associated with only one respective end of the handle, wherein the hanging device rotates with rotation of the handle between a hanging orientation when the handle is in the lowered position and a non-hanging orientation when the handle is in the raised position, wherein the hanging device includes at least one arm that extends outwardly at approximately 90 degrees relative to the one respective end of the handle and the vessel along the axis of rotation and in primarily a single plane and a lip that extends at approximately 90 degrees from an end of the at least one arm that is remote from the vessel, and wherein the at least one arm at least partially supports the vessel and the lip is below the single plane of the at least one arm when the handle is in the lowered position and the vessel is hung using the hanging device and the lip of the hanging device rotates out of lateral interference with an upright member associated with hanging the vessel as the handle rotates toward the raised position such that an edge of the at least one arm defines a lowest edge of the hanging device and the lip is disposed above the edge of the at least one arm when the handle is oriented in the raised position.

2. The container of claim 1 wherein the handle comprises a bail having a first end connected to one side of the vessel and a second end connected to an opposite side of the vessel, and wherein the hanging device is connected to one end of the bail.

3. The container of claim 2 wherein the bail is rotatable from a centered raised position above the vessel to first and second lowered positions defined at respective sides of the vessel.

4. The container of claim 3 wherein the handle has a gripping portion such that the gripping portion is spaced from the respective side of vessel when the bail is at either of the first and second lowered position.

5. The container of claim 2 wherein the vessel, has an opening into which a removable material may be loaded and wherein the bail is located between about 0 and 2 inches below said opening.

6. The container of claim I wherein the vessel has a substantially flat bottom portion for supporting the vessel on a horizontal surface and wherein the hanging device is angled upwardly relative to said substantially flat bottom portion.

7. The container of claim 2 wherein the vessel contains a first and a second protrusion extending from respective opposite sides thereof, and wherein the first and the second ends of the bail each comprise an arcuate section adapted to fit over a respective protrusion of the vessel.

8. The container of claim 7 wherein the first and the second ends fit over their respective protrusions in a manner that allows rotation of the arcuate section around the protrusions.

9. The container of claim 8 wherein the hanging device is connected to one of the arcuate sections and configured to rotate with rotation of the one arcuate section.

10. The container of claim 1 wherein the handle has a gripping portion centered between first and second sides of the vessel.

11. The container of claim 1 wherein the hanging device is removable from the vessel in a substantially tool-free manner.

12. The container of claim 1 wherein the hanging device either leads or trails the vessel when the vessel is being carried with the handle aligned with the direction of travel of a user whose hand is grasping the handle.

13. The container of claim 1, wherein when the hanging device is engaged with the upright member, rotating the handle from the lowered position to the raised position disengages the hanging device from the upright member.

14. A. container configured to be selectively coupled to an upright member, the container comprising:

a vessel having an internal volume adapted to be loaded with a removable material;

a bail residing primarily in a single plane, connected to the vessel at a pair of opposing ends, wherein the bail is rotatable between a raised position and first and second lowered positions and comprising a handle disposed between the pair of opposing ends and configured for grasping by a user of the container;

a hanging device connected to the bail at a location outboard of one of the pair of opposing ends of the bail and configured to rotate with the rotation of the bail between a hanging position when the bail is in the first lowered position and a non-hanging position when the bail is in the raised position, wherein the hanging device comprises, at least one support member extending away from the bail at approximately 90 degrees in primarily a single plane; and a lip extending from said at least one support member at approximately 90 degrees such that when said bail is in the first lowered position the lip extends below the primary plane of the bail and the primary plane of the at least one support member and when said hail is in the raised position the at least one support member defines a lowest edge of the hanging device and the lip is located entirely above the at least one support member.

15. A container according to claim 14, wherein the at least one support member comprises two arms and the lip extends from and connects the two arms.

16. A container according to claim 14, wherein the at least one support member provides at least partial support for the vessel when the vessel is hung on a generally upright structure using the hanging device.

17. An ice tote comprising:

a vessel having an open top and a closed bottom and a sidewall arrangement extending generally uprightly from the closed bottom to the open top;

a wire having a first end rotatably mounted to a first sidewall of the vessel and a second end rotatably mounted to a second sidewall of the vessel and movable between a raised and lowered position, the wire including a handle for transporting the vessel; and a hanger coupled to the wire and located outside of an area between the first end and the second end of the wire for hanging the vessel on a generally upright structure, the hanger adapted to rotate with rotation of the wire wherein the hanger is configured to be selectively engageable with the generally upright structure when the wire is in the lowered position and wherein the hanger is positioned oblique relative to the upright structure when the wire is in the raised position and wherein the hanger includes at least one arm that extends outwardly relative to the wire at approximately 90 degrees and a lip that extends outwardly relative to both the at least one arm and to an axis of rotation of rotation of the wire at approximately 90 degrees and wherein the at least one arm at least partially supports the vessel and the lip extends in a downward direction from the at least one arm such that a portion of the generally upright structure is disposed between the lip, the at least one arm, and the vessel when the handle is in the lowered position and the vessel is hung on the generally upright structure using the hanger and an edge of the at least one arm defines a lowest edge of the hanger and the lip is located entirely above the generally upright when the handle is in the raised position.

18. The ice tote of claim 17 wherein the first sidewall includes a first anchor point and the second sidewall includes a second anchor point, and wherein the wire includes a first curved end rotatably engaged about the first anchor point and includes a second curved end rotatably engaged about the second anchor point, and wherein the hanger is coupled to one of the first curved end or the second curved end.

* * * * *

UNITED STATES PATENT AND TRADEMARK OFFICE

CERTIFICATE OF CORRECTION

PATENT NO. : 9,051,086 B2
APPLICATION NO. : 12/694040
DATED : June 9, 2015
INVENTOR(S) : Andrew P. Lynch et al.

It is certified that error appears in the above-identified patent and that said Letters Patent is hereby corrected as shown below:

IN THE CLAIMS

Claim 5, column 7, line 32, after "vessel" delete ",";

Claim 14, column 7, line 64, after "A" delete ".";

Claim 14, column 8, line 21, delete "hail" and substitute therefore -- bail --.

Signed and Sealed this
Third Day of November, 2015

Michelle K. Lee

Michelle K. Lee
*Director of the United States Patent and Trademark Office*